US009847594B2

(12) United States Patent
Zhang

(10) Patent No.: US 9,847,594 B2
(45) Date of Patent: Dec. 19, 2017

(54) CABLE CONNECTOR

(71) Applicant: ENERGY FULL ELECTRONICS, New Taipei (TW)

(72) Inventor: Lingyuan Zhang, New Taipei (TW)

(73) Assignee: ENERGY FULL ELECTRONICS, New Taipei (TW)

( * ) Notice: Subject to any disclaimer, the term of this patent is extended or adjusted under 35 U.S.C. 154(b) by 0 days.

(21) Appl. No.: 14/334,734

(22) Filed: Jul. 18, 2014

(65) Prior Publication Data

US 2015/0072554 A1 Mar. 12, 2015

Related U.S. Application Data

(60) Provisional application No. 61/874,698, filed on Sep. 6, 2013.

(51) Int. Cl.

| | |
|---|---|
| ***H01R 13/6474*** | (2011.01) |
| ***H01R 13/405*** | (2006.01) |
| ***H01R 13/506*** | (2006.01) |
| *H01R 43/24* | (2006.01) |
| *H01R 107/00* | (2006.01) |

(52) U.S. Cl.

CPC ..... *H01R 13/506* (2013.01); *H01R 13/405* (2013.01); *H01R 13/6474* (2013.01); *H01R 43/24* (2013.01); *H01R 2107/00* (2013.01)

(58) Field of Classification Search

CPC .. H01R 13/743; H01R 13/745; H01R 13/405; H01R 13/506; H01R 13/6474; H01R 12/79; H01R 12/592; H01R 43/24; H01R 4/20

USPC ..... 439/877, 499, 472, 557, 941, 660, 76.1

See application file for complete search history.

(56) References Cited

U.S. PATENT DOCUMENTS

| | | | | |
|---|---|---|---|---|
| 6,648,676 | B1 * | 11/2003 | Lee | H01R 43/24 439/499 |
| 6,790,075 | B1 * | 9/2004 | Sung | H01R 12/592 439/397 |
| 6,824,426 | B1 | 11/2004 | Spink, Jr. | |
| 6,832,931 | B1 * | 12/2004 | Wu | H01R 12/592 439/499 |
| 6,887,104 | B2 * | 5/2005 | Lee | H01R 43/0249 439/374 |

(Continued)

FOREIGN PATENT DOCUMENTS

| | | |
|---|---|---|
| CN | 1655408 A | 8/2005 |
| TW | I257750 | 7/2006 |

*Primary Examiner* — Amy Cohen Johnson
*Assistant Examiner* — Milagros Jeancharles
(74) *Attorney, Agent, or Firm* — Hauptman Ham, LLP

(57) ABSTRACT

A cable connector with a first body, a plurality of terminals, and a plurality of wires is provided. The first body comprises a plurality of first slots and a plurality of second slots. The terminals comprise a plurality of first terminals and a plurality of second terminals. Each of the first terminals and the second terminals comprises a contacting zone, a fixing zone, and a riveting zone. The first terminals and the second terminals are respectively in the first slots and the second slots of the first body. Each of the wires having a connecting part corresponding to one of the riveting zones of the first terminals and the second terminals, and a part of some of the wires are covered by insulating layers. The connecting parts of the wires are connected with the riveting zones of the corresponding terminals.

15 Claims, 8 Drawing Sheets

(56) References Cited

U.S. PATENT DOCUMENTS

| | | | | |
|---|---|---|---|---|
| 6,939,164 | B2 * | 9/2005 | Noro | H01R 4/2429 439/492 |
| 6,976,869 | B1 * | 12/2005 | Wu | H01R 9/03 439/499 |
| 7,134,908 | B2 * | 11/2006 | Wu | H01R 25/00 439/502 |
| 7,651,379 | B1 * | 1/2010 | Wu | H01R 12/62 439/108 |
| 7,794,273 | B2 * | 9/2010 | Xu | H01R 13/621 411/45 |
| 7,798,834 | B2 * | 9/2010 | Wu | 439/247 |
| 7,922,527 | B2 * | 4/2011 | Xu | H01R 13/743 439/557 |
| 8,672,689 | B2 * | 3/2014 | Tseng | H01R 12/62 439/493 |
| 8,758,030 | B2 * | 6/2014 | Chen | H01R 12/77 439/493 |
| 8,845,341 | B2 * | 9/2014 | Chen | H01R 12/79 439/493 |
| 9,219,319 | B2 * | 12/2015 | Chen | H01R 12/592 |
| 9,312,620 | B2 * | 4/2016 | Chen | H01R 12/79 |
| 2003/0003793 | A1 * | 1/2003 | Chang | H01R 13/26 439/402 |
| 2005/0272303 | A1 * | 12/2005 | Wu | H01R 9/03 439/499 |
| 2006/0270271 | A1 * | 11/2006 | Moriyama | H01R 9/032 439/499 |
| 2012/0252260 | A1 * | 10/2012 | Tseng | H01R 12/62 439/499 |

* cited by examiner

CABLE CONNECTOR

CROSS REFERENCE TO RELATED APPLICATION

This application claims the benefit of U.S. Provisional Patent Application Ser. No. 61/874,698, filed Sep. 06, 2013.

BACKGROUND OF THE INVENTION

1. Field of Invention

The invention relates to a cable connector, and more particularly, a process art of applying a riveting method to a SATA (Serial Advanced Technology Attachment) cable connector.

2. Description of Prior Art

A prior art skill of a cable connector is disclosed in TIPO (Taiwan Intellectual Property Office) Patent No. I257750 patent (the foreign patent families of the said Taiwan Patent are CN 1655408 A and U.S. Pat. No.6,824,426 B1). FIG. 1 is an exploded schematic view of a cable connector of a prior art. The cable connector 100 comprises the wires 3 and terminals 2. The terminals 2 and wires 3 are connected by the welding method, and the welding method is very labor intensive.

BRIEF SUMMARY OF THE INVENTION

The main purposes of the present invention are to provide a cable connector to dispose a riveting zone on each terminal relative to a connecting part of the wires, and to connect each terminal and each wire by the riveting method.

One of the main purposes of the present invention is to provide a cable connector which comprises a first body, a plurality of terminals, and a plurality of wires.

The first body comprises a plurality of first slots and a plurality of second slots. The terminals comprise a plurality of first terminals and a plurality of second terminals, each of the first terminals and the second terminals having a contacting zone, a fixing zone, and a riveting zone, and the first terminals and the second terminals are respectively in the first slots and the second slots of the first body. Each of the wires comprises a connecting part corresponding to one of the riveting zones of the first terminals and the second terminals and a part of some of the wires are covered by insulating layers.

The connecting parts of the wires are connected with the riveting zones of the corresponding terminals.

According to a preferred embodiment of the present invention, the first body further comprises a locking portion, and the cable connector further comprises a second body, the second body further comprises a locked portion, the second body is fixed on the first body from a back side of the first body, and the second terminals are fixed on the first body with the locking portion of the first body and the locked portion of the second body.

According to a preferred embodiment of the present invention, the second body comprises a plurality of fixing areas to fix the second terminals.

According to a preferred embodiment of the present invention, a space between the second terminals, the fixing areas, and the first body is filled by colloid or the space is plugged by a back cover.

According to a preferred embodiment of the present invention, the cable connector further comprises a back cover. The back cover comprises a plurality of projections, part of the projections are fixed with the first body to fix the back cover on the first body from a back side of the first body.

According to a preferred embodiment of the present invention, the back cover comprises a plurality of fixing areas to fix part of the first terminals.

According to a preferred embodiment of the present invention, the fixing zones of part of the first terminals are embedded into the first slots of the first body from the back side of the first body.

According to a preferred embodiment of the present invention, the contacting zones of part of the first terminals are electrically connected with the riveting zone of part of the first terminals by the method of many to one.

According to a preferred embodiment of the present invention, there are a plurality of first intervals between the riveting zones of the second terminals and a plurality of second intervals between the contacting zones of the second terminals. The first intervals are larger than or equal to the second intervals.

According to a preferred embodiment of the present invention, the second terminals further comprises a plurality of connecting zones between the riveting zones and the contacting zones of the second terminals, a length of the connecting zone of one of the second terminals and a length of the connecting zone of another second terminal adjacent to the one of the second terminals are the same.

According to a preferred embodiment of the present invention, part of each of the second terminals between the contacting zone and the riveting zone is bending line shaped or curving line shaped.

Another of the main purposes of the present invention is to provide a cable connector which comprises a back cover, a first body, a plurality of terminals, and a plurality of wires.

The back cover comprises a plurality of projections. The first body comprises a plurality of first slots and a plurality of second slots. The terminals comprise a plurality of first terminals and a plurality of second terminals, each of the first terminals and the second terminals having a contacting zone, a fixing zone, and a riveting zone, and the first terminals and the second terminals are respectively in the first slots and the second slots of the first body. Each of the wires comprises a connecting part corresponding to one of the riveting zones of the first terminals and the second terminals and a part of some of the wires are covered by insulating layers.

The connecting parts of the wires are connected with the riveting zones of the corresponding terminals. Part of the projections are fixed with the first body to fix the back cover on the first body from a back side of the first body.

According to another preferred embodiment of the present invention, the first body further comprises a locking portion. The cable connector further comprises a second body, and the second body further comprises a locked portion, the second body is fixed on the first body from the back side of the first body, and the second terminals are fixed on the first body with the locking portion of the portion of the first body and the locked portion of the second body.

According to another preferred embodiment of the present invention, the second body comprises a plurality of fixing areas to fix the second terminals.

According to another preferred embodiment of the present invention, a space between the second terminals, the fixing area, and the first body is filled by colloid or the space is plugged by a back cover.

According to another preferred embodiment of the present invention, the back cover comprises a plurality of fixing areas to fix part of the first terminals.

According to another preferred embodiment of the present invention, the fixing zones of part of the first terminals are embedded into the back side of the first body.

According to another preferred embodiment of the present invention, the contacting zones of part of the first terminals are electrically connected with the riveting zone of part of the first terminals by the method of many to one.

According to another preferred embodiment of the present invention, there are a plurality of first intervals between the riveting zones of the second terminals and a plurality of second intervals between the contacting zones of the second terminals, and the first intervals are larger than or equal to the second intervals.

According to another preferred embodiment of the present invention, the second terminals further comprises a plurality of connecting zones between the riveting zones and the contacting zones of the second terminals, a length of the connecting zone of one of the second terminals and a length of the connecting zone of another second terminal adjacent to the one of the second terminals are the same.

According to another preferred embodiment of the present invention, part of each of the second terminals between the contacting zone and the riveting zone is bending line shaped or curving line shaped.

The advantage of the present invention is to solve the problem of riveting caused by small intervals between the terminals and the wires, and simplifying the cable connector assembly process.

DETAILED DESCRIPTION OF THE PREFERRED EMBODIMENTS

The following descriptions of all embodiments, with reference to the accompanying drawings, are used to exemplify the present invention. Directional terms mentioned in the present invention, such as "top", "bottom", "front", "back", "left", "right", "inside", "outside", "side", etc., are only used with reference to the orientation of the accompanying drawings. Therefore, the used directional terms are intended to illustrate, but not to limit, the present invention.

Figure 1:
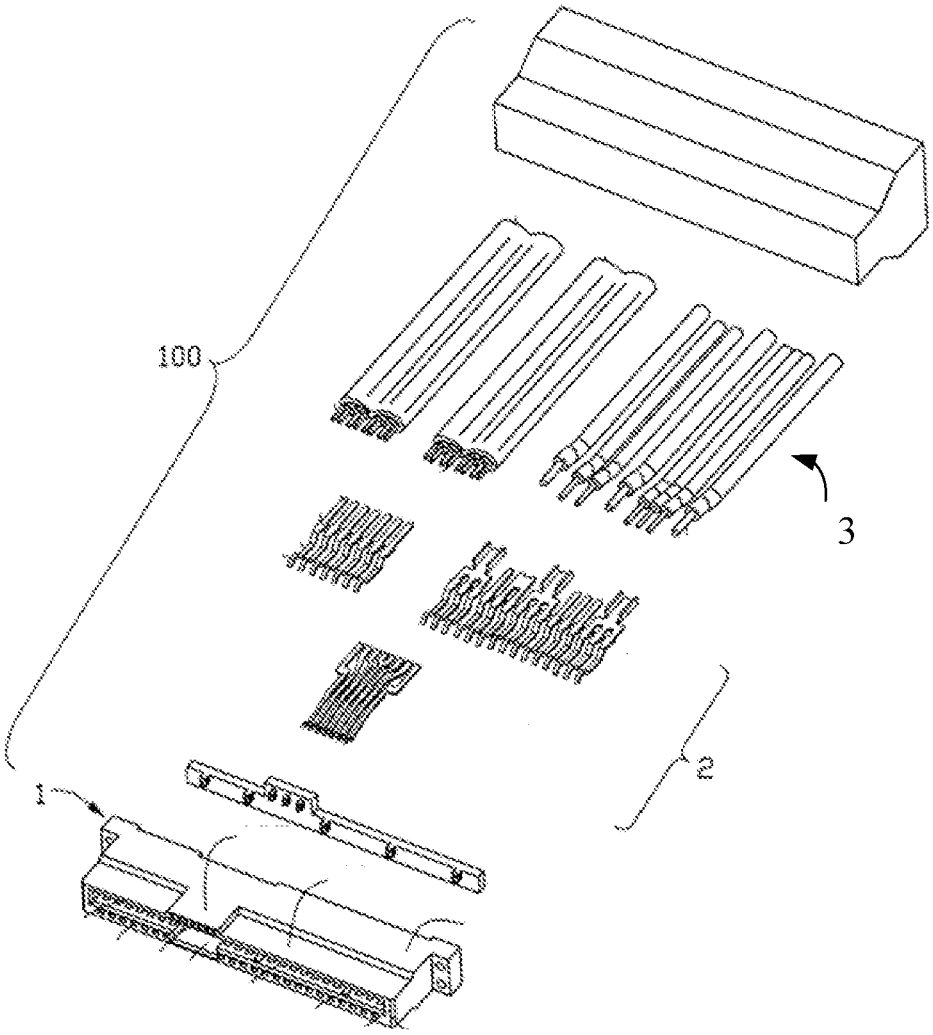
Fig. 1 (Prior Art)
FIG. 1 is an exploded schematic view of a cable connector of a prior art.
Figure 2:
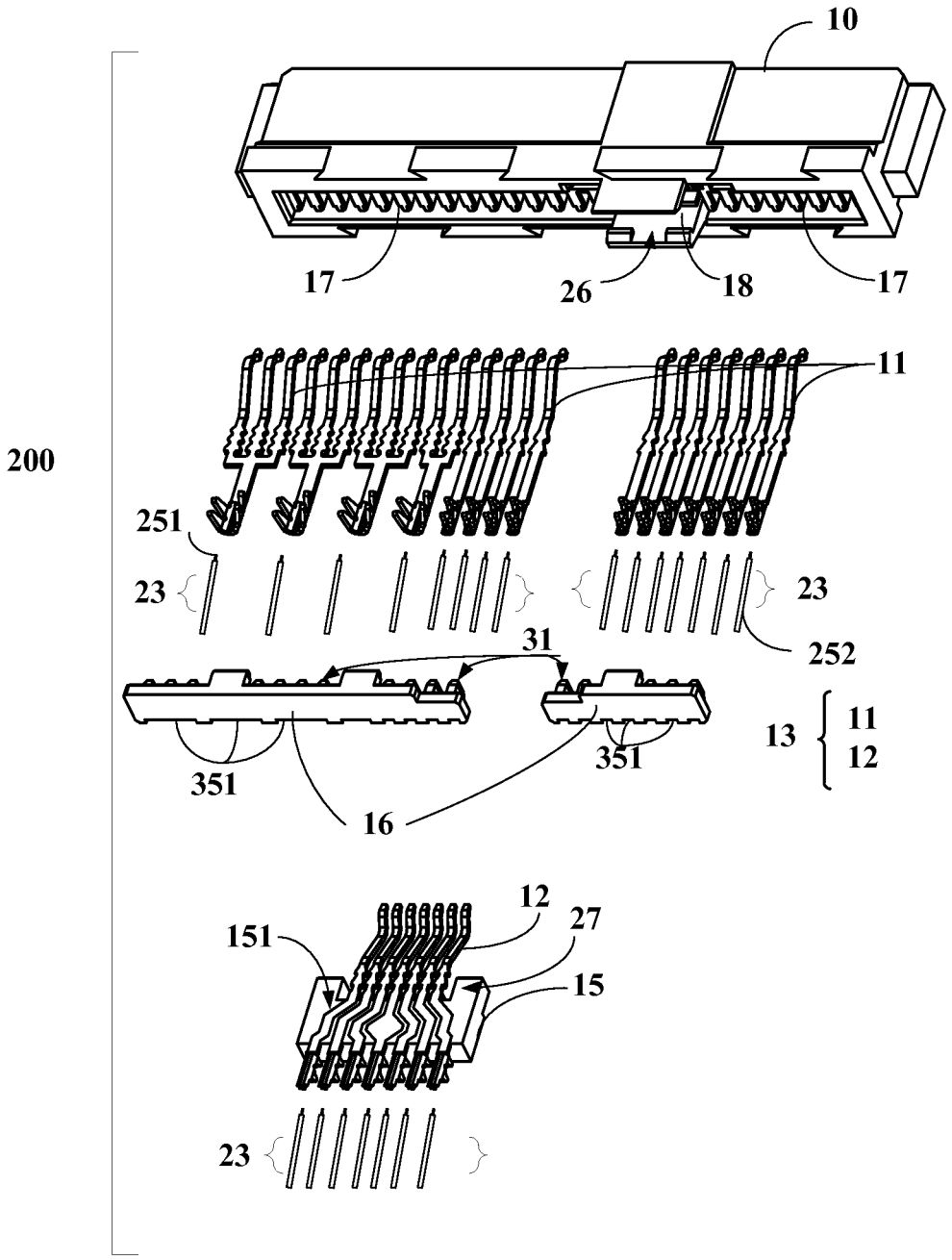
FIG. 2 is an exploded schematic view of a cable connector of a first preferred embodiment of the present invention.
Figure 3:
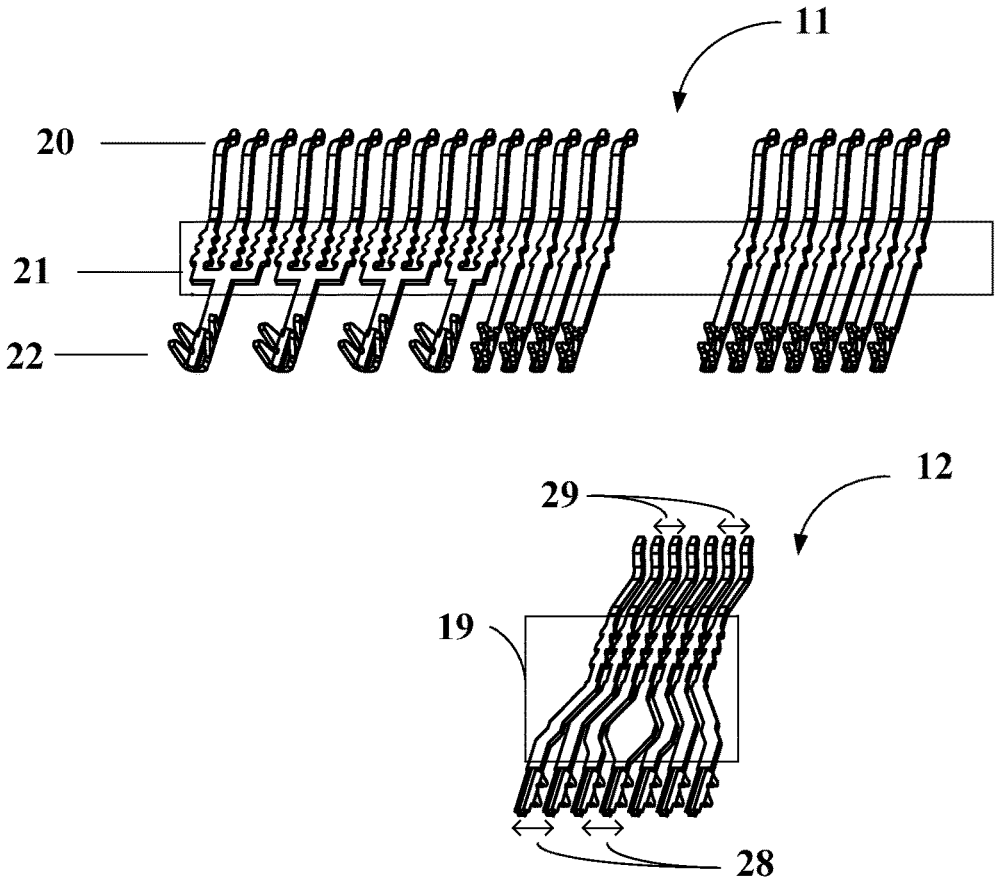
FIG. 3 is a detailed structure drawing of the terminals in FIG. 2.

Referring to FIG. 2 and FIG. 3. FIG. 2 is an exploded schematic view of a cable connector of a first preferred embodiment of the present invention. FIG. 3 is a detailed structure drawing of the terminals in FIG. 2. A cable connector 200 comprises a first body 10, a second body 15, a back cover 16, a plurality of terminals 13, and a plurality of wires 23.

The first body 10 comprises a plurality of first slots 17, a plurality of second slots 18, and a locking portion 26. The second body 15 comprises a locked portion 27 and a plurality of fixing areas 151. The back cover 16 comprises a plurality of projections 31 and a plurality of fixing areas 351.

Each of the terminals 13 comprises a plurality of first terminals 11 and a plurality of second terminals 12. Each of the first terminals 11 and the second terminals 12 having a contacting zone 20, a fixing zone 21, and a riveting zone 22, and the first terminals 11 and the second terminals 12 are respectively in the first slots 17 and the second slots 18 of the first body 10.

The contacting zones 20 of part of the first terminals 11 are electrically connected with the riveting zone 22 of part of the first terminals 11 by the method of many to one.

There are a plurality of first intervals 28 between the riveting zones 22 of the second terminals 12 and a plurality of second intervals 29 between the contacting zones 20 of the second terminals 12, and the first intervals 28 are larger than or equal to the second intervals 29.

Moreover, the second terminals 12 further comprises a plurality of connecting zones 19 between the riveting zones 22 and the contacting zones 20 of the second terminals 12, a length of the connecting zone 19 of one of the second terminals 12 and a length of the connecting zone 19 of another second terminal 12 adjacent to the one of the second terminals are the same. Consideration of the different lengths of the connecting zones 19 will cause problems during signal transfer, part of each of the second terminals 12 between the contacting zone 20 and the riveting zone 22 (the connecting zone 19) is bending line shaped or curving line shaped to make the lengths of the connecting zones 19 be the same, even when the first intervals 28 are larger than or equal to the second intervals 29.

Each of the wires 23 having a connecting part 251 to one of the riveting zones 22 of the corresponding terminals 13 (the first terminals 11 and the second terminals 12), and a part of some of the wires 23 are covered by insulating layers 252. The connecting parts 251 of the wires 23 are connected with the riveting zones 22 of the corresponding terminals 13 (the first terminals 11 and the second terminals 12).

In the embodiment, the first terminals 11 are fixed in the first body 10 corresponding to the fixing zones 21 of the first slots 17. Moreover, the first terminals 11 are embedded into the first body 10 from a back side of the first body 10. Then, part of the projections 31 are connected with the first body 10 to make the back cover 16 to be fixed on the first body 10 from the back side of the first body 10.

The second terminals 12 are embedded into the fixing area 151 of the second body 15 by the connecting zones 19. The locked portion 27 is fixed together with the locking portion 26, making the second body 15 to be fixed on the first body 10 from the back side of the first body 10. The second terminals 12 are fixed on the first body. Finally, a space between the second terminals 12, the fixing areas 151 of the second body 15, and the first body 10 is filled by colloid or the space is plugged with the back cover 16, avoiding problems during signal transfer caused by excess glue in the contacting zones 20 of the terminals 13 left by injection molding.

Figure 4:
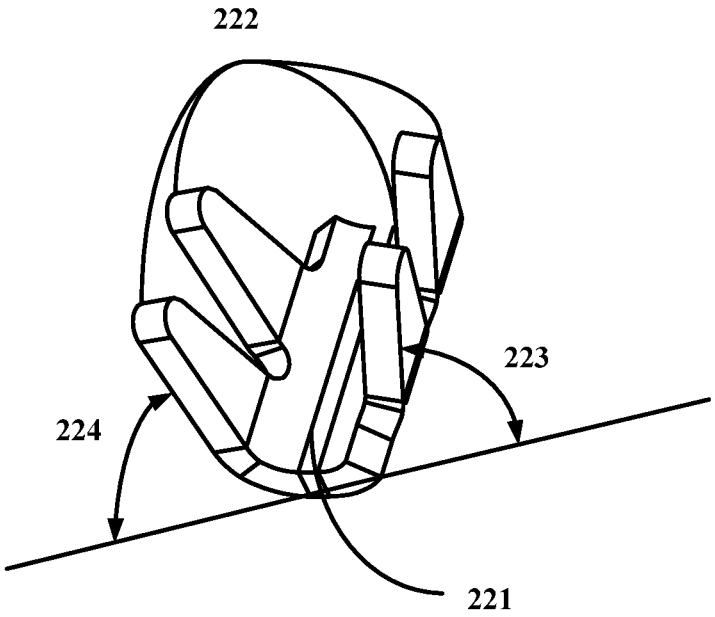
FIG. 4 is a detailed structure drawing of the riveting zones of the terminals of FIG. 2.

FIG. 4 is a detailed structure drawing of the riveting zones 22 of the terminals of FIG. 2. Each of the riveting zones 22 comprises at least one clamping portion 222 and a holding portion 221, an angle (223, 224) between the clamping portions 222 and holding portion 221 is between 0-90 degrees.

Figure 5:
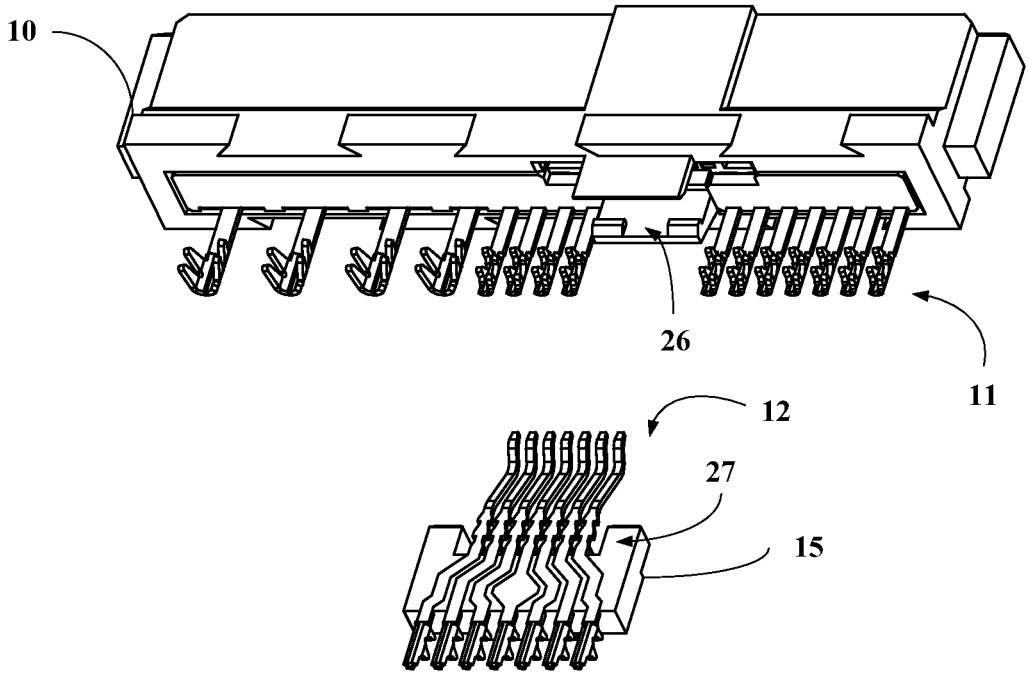
FIG. 5 is a semi-packaged schematic view of a cable connector of a first preferred embodiment of the present invention.

FIG. 5 is a semi-packaged schematic view of a cable connector of a first preferred embodiment of the present invention. In drawing, the first terminals 11 are all embedded into the first body 10, the back cover 16 is also assembled in the first body 10. Only the second body 15 and the second terminals 12 fixed thereon could be assembled to the first body 10 by the locking portion 26 and locked portion 27 after the wires 23 are assembled. In this manner, it is possible to shorten the assembling time because processing the packaging of the first terminals 11 and the second terminals 12 at the same time can be realized.

The difference between the present invention and the prior art is that one side of each of the first terminals 11 and the second terminals 12 is disposed in the riveting zones 22 in the present invention. By adjusting the intervals between the terminals 13 (the first terminals 11 and the second terminals 12), the process of assembling the terminals 13 (the first terminals 11 and the second terminals 12) and the wires 23 can be done with a riveting machine, rather than by labor intensive welding, as in the prior art.

Figure 6:
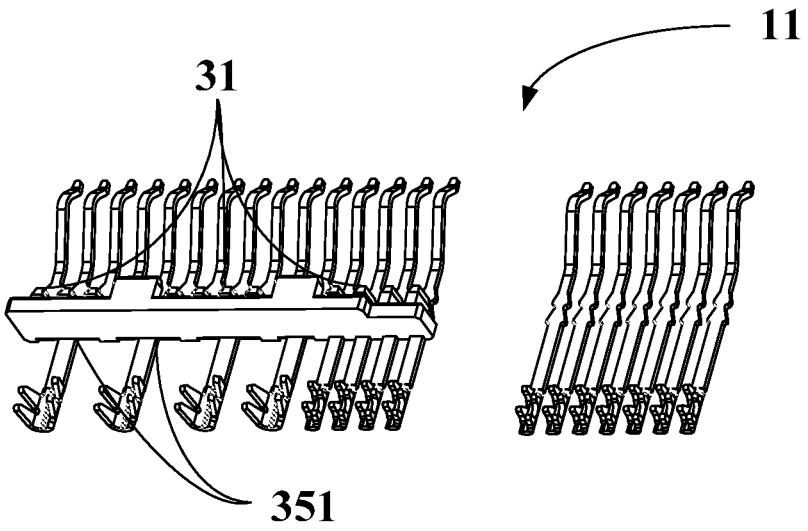
FIG. 6 is an exploded schematic view of the terminals of the cable connector of a second preferred embodiment of the present invention.
Figure 7:
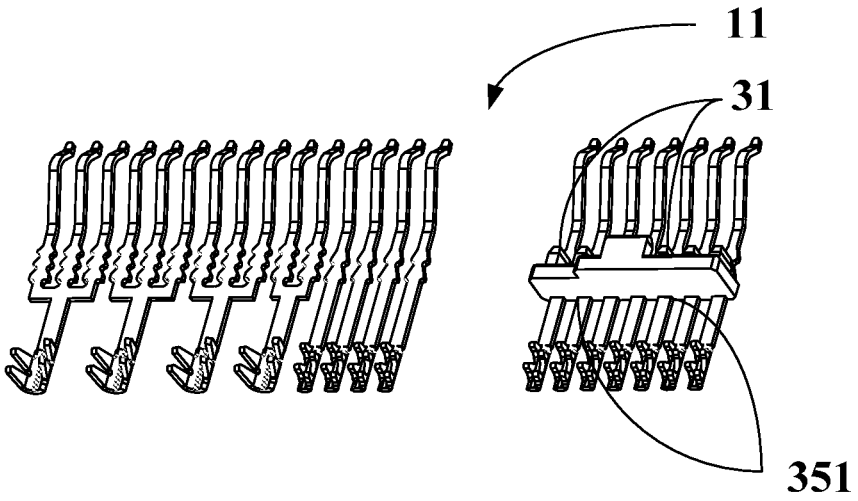
FIG. 7 is an exploded schematic view of the terminals of the cable connector of a third preferred embodiment of the present invention.

Referring to FIG. 6 and FIG. 7, FIG. 6 is an exploded schematic view of the terminals of the cable connector of a second preferred embodiment of the present invention, and FIG. 7 is an exploded schematic view of the terminals of the cable connector of a third preferred embodiment of the present invention. The difference between the second embodiment, the third embodiment, and the first embodiment is that part of the first terminals 11 are not fixed on the first slots 17 of the first body 10 by the fixing zones 21 directly. Rather, part of the first terminals 11 and the back cover 16 are integrally molded firstly, and then assembled with the first body 10 by the back cover 16.

Figure 8:
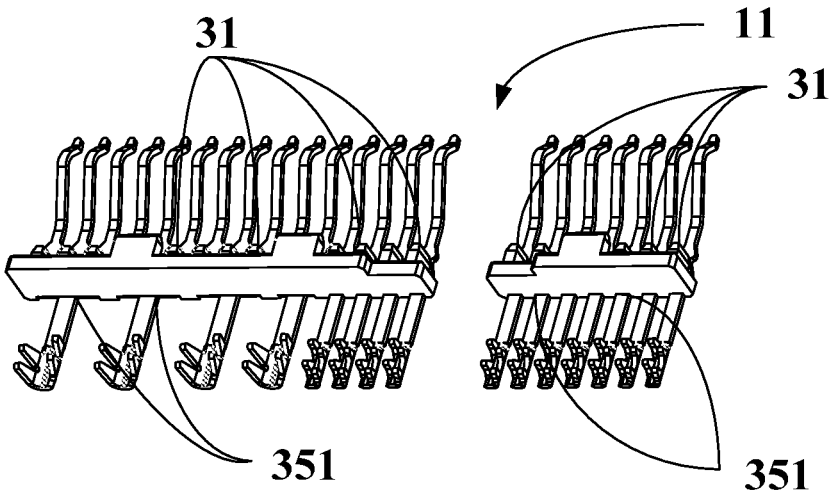
FIG. 8 is an exploded schematic view of the terminals of the cable connector of a fourth preferred embodiment of the present invention.

FIG. 8 is an exploded schematic view of the terminals of the cable connector of a fourth preferred embodiment of the present invention. The difference between the fourth embodiment and the first embodiment is that all of the first terminals 11 are not fixed on the first slots 17 of the first body 10 by the fixing zones 21 directly. Rather, all of the first terminals 11 and the back cover 16 are integrally molded firstly, and then assembled with the first body 10 by the back cover 16.

Although the present invention has been disclosed as preferred embodiments, the foregoing preferred embodiments are not intended to limit the present invention. Those of ordinary skill in the art, without departing from the spirit and scope of the present invention, can make various kinds of modifications and variations to the present invention. Therefore, the scope of the claims of the present invention must be defined.

What is claimed is:

1. A cable connector comprising:

a first body comprising a plurality of first slots and a plurality of second slots;

a plurality of terminals comprising a plurality of first terminals and a plurality of second terminals, each of the first terminals and the second terminals having a contacting zone, a fixing zone, and a riveting zone, and the first terminals and the second terminals are respectively in the first slots and the second slots of the first body; and a plurality of wires, each of the wires having a connecting part corresponding to one of the riveting zones of the first terminals and the second terminals and a part of some of the wires are covered by insulating layers, wherein the connecting parts of the wires are connected with the riveting zones of the corresponding terminals, wherein the riveting zone comprises a holding portion and a clamping portion bent upwards to clamp the connecting part of the wire, wherein the second terminals further comprises a plurality of connecting zones between the riveting zones and the contacting zones of the second terminals, a length of the connecting zone of one of the second terminals and a length of the connecting zone of another second terminal adjacent to the one of the second terminals are the same, and the connecting zone of one of the second terminals and the connecting zone of another second terminal adjacent to the one of the second terminals are not parallel in a top view, wherein the first body further comprises a locking portion, and the cable connector further comprises a second body, and the second body further comprises a locked portion and a plurality of fixing areas to fix the second terminals, the second body is fixed on the first body from a back side of the first body, and the second terminals are fixed on the first body with the locking portion of the first body and the locked portion of the second body, wherein the connecting zones of the second terminals are fittingly molded onto the plurality of fixing areas of the second body, and the riveting zones and the contacting zones of the second terminals protrude out of the second body, and wherein clamping portions of the plurality of first terminals are bent upwards and extended in a first direction in relative to an extending direction of the holding portion, and clamping portions of the plurality of second terminals are bent downwards and extended in a second direction opposite to the first direction.

2. The cable connector according to claim 1, wherein a space between the fixing areas, and the first body is filled by colloid or the space is plugged by a back cover.

3. The cable connector according to claim 1, wherein the cable connector further comprises a back cover, the back cover comprises a plurality of projections, part of the projections are fixed together with the first body to fix the back cover on the first body from a back side of the first body.

4. The cable connector according to claim 3, wherein the back cover comprises a plurality of fixing areas to fix part of the first terminals.

5. The cable connector according to claim 4, wherein the fixing zones of a part of the first terminals are embedded into the first slots of the first body from the back side of the first body.

6. The cable connector according to claim 1, wherein the contacting zones of part of the first terminals are electrically connected with the riveting zones of part of the first terminals by the method of many to one.

7. The cable connector according to claim 1, wherein there are a plurality of first intervals between the riveting zones of the second terminals and a plurality of second intervals between the contacting zones of the second terminals, and the first intervals are larger than or equal to the second intervals.

8. The cable connector according to claim 1, wherein part of each of the second terminals between the contacting zone and the riveting zone is bending line shaped or curving line shaped.

9. A cable connector comprising:

a back cover comprising a plurality of projections;

a first body comprising a plurality of first slots and a plurality of second slots;

a plurality of terminals comprising a plurality of first terminals and a plurality of second terminals, each of the first terminals and the second terminals having a contacting zone, a fixing zone, and a riveting zone, and the first terminals and the second terminals are respectively in the first slots and the second slots of the first body; and a plurality of wires, each of the wires having a connecting part corresponding to one of the riveting zones of the first terminals and the second terminals and a part of some of the wires are covered by insulating layers, wherein the connecting parts of the wires are connected with the riveting zones of the corresponding terminals, part of the projections are fixed together with the first body to fix the back cover on the first body from a back side of the first body, wherein the riveting zone comprises a holding portion and a clamping portion bent upwards to clamp the connecting part of the wire, wherein the second terminals further comprises a plurality of connecting zones between the riveting zones and the contacting zones of the second terminals, a length of the connecting zone of one of the second terminals and a length of the connecting zone of another second terminal adjacent to the one of the second terminals are the same, and the connecting zone of one of the second terminals and the connecting zone of another second terminal adjacent to the one of the second terminals are not parallel in a top view, wherein the first body further comprises a locking portion, and the cable connector further comprises a second body, and the second body further comprises a locked portion and a plurality of fixing areas to fix the second terminals, the second body is fixed on the first body from a back side of the first body, and the second terminals are fixed on the first body with the locking portion of the first body and the locked portion of the second body, wherein the connecting zones of the second terminals are fittingly molded onto the plurality of fixing areas of the second body, and the riveting zones and the contacting zones of the second terminals protrude out of the second body, and wherein clamping portions of the first terminals are bent upwards and extended in a first direction in relative to an extending direction of the holding portion, and clamping portions of the second terminals extend in a second direction opposite to the first direction.

10. The cable connector according to claim 9, wherein a space between the second terminals, the fixing areas, and the first body is filled by colloid or the space is plugged by a back cover.

11. The cable connector according to claim 9, wherein the back cover comprises a plurality of fixing areas to fix part of the first terminals.

12. The cable connector according to claim 11, wherein the fixing zones of part of the first terminals are embedded into the first slots of the first body from the back side of the first body.

13. The cable connector according to claim 9, wherein the contacting zones of part of the first terminals are electrically connected with the riveting zone of part of the first terminals by the method of many to one.

14. The cable connector according to claim 9, wherein there are a plurality of first intervals between the riveting zones of the second terminals and a plurality of second intervals between the contacting zones of the second terminals, and the first intervals are larger than or equal to the second intervals.

15. The cable connector according to claim 9, wherein part of each of the second terminals between the contacting zone and the riveting zone is bending line shaped or curving line shaped.

* * * * *